US008800646B2

(12) United States Patent
Harkins et al.

(10) Patent No.: US 8,800,646 B2
(45) Date of Patent: Aug. 12, 2014

(54) SAFETY DEVICE FOR RETRIEVING COMPONENT WITHIN WELLHEAD

(75) Inventors: Randall Dean Harkins, Spring, TX (US); Kirk Paul Guidry, Cypress, TX (US); Thomas Edgar Taylor, Houston, TX (US)

(73) Assignee: Cameron International Corporation, Houston, TX (US)

( * ) Notice: Subject to any disclaimer, the term of this patent is extended or adjusted under 35 U.S.C. 154(b) by 53 days.

(21) Appl. No.: 12/743,818

(22) PCT Filed: Nov. 13, 2008

(86) PCT No.: PCT/US2008/083461

§ 371 (c)(1),
(2), (4) Date: May 19, 2010

(87) PCT Pub. No.: WO2009/079124

PCT Pub. Date: Jun. 25, 2009

(65) Prior Publication Data

US 2010/0252251 A1 Oct. 7, 2010

Related U.S. Application Data

(60) Provisional application No. 61/013,914, filed on Dec. 14, 2007.

(51) Int. Cl.
*E21B 33/06* (2006.01)

(52) U.S. Cl.
USPC ..... 166/85.4; 166/85.1; 166/75.11

(58) Field of Classification Search
USPC ..... 166/85.4, 85.1, 75.11, 84.5; 285/123.1–123.17
See application file for complete search history.

(56) References Cited

U.S. PATENT DOCUMENTS

| | | | | |
|---|---|---|---|---|
| 3,680,632 | A * | 8/1972 | Myers | 166/89.1 |
| 4,071,085 | A * | 1/1978 | Grable et al. | 166/84.4 |
| 4,317,486 | A | 3/1982 | Harris | |
| 4,782,894 | A | 11/1988 | LaFleur | |
| 4,804,045 | A | 2/1989 | Reed | |
| 7,322,407 | B2 * | 1/2008 | Duhn et al. | 166/75.14 |
| 2004/0251036 | A1 * | 12/2004 | Hopper et al. | 166/384 |
| 2004/0261992 | A1 * | 12/2004 | Belshaw et al. | 166/264 |

FOREIGN PATENT DOCUMENTS

| | | |
|---|---|---|
| EP | 1233145 | 8/2002 |
| GB | 2377954 | 1/2003 |

OTHER PUBLICATIONS

PCT International Search Report and Written Opinion for PCTUS2008/083461, dated Mar. 19, 2009.

* cited by examiner

*Primary Examiner* — Yong-Suk (Philip) Ro
(74) *Attorney, Agent, or Firm* — Fletcher Yoder, P.C.

(57) ABSTRACT

A system is provided that includes a safety device configured to mount in a mineral extraction system and block axial movement of a plug in the mineral extraction system while the plug is released from a retainer. The safety device may be a sleeve configured to receive screws or other retention mechanism in a tubular. A method is provided that includes installing a plug safety catch into a tubular of a mineral extraction system in which the safety device is configured to block axial movement of a plug in response to a pressure differential while the plug is released from a mount position.

31 Claims, 5 Drawing Sheets

SAFETY DEVICE FOR RETRIEVING COMPONENT WITHIN WELLHEAD

CROSS-REFERENCE TO RELATED APPLICATIONS

This application claims priority to and benefit of PCT Patent Application No. PCT/US2008/083461, entitled "Safety Device for Retrieving Component Within Wellhead," filed Nov. 13, 2008, which is herein incorporated by reference in its entirety, and which claims priority to and benefit of U.S. Provisional Patent Application No. 61/013,914, entitled "Safety Device for Retrieving Component Within Wellhead", filed on Dec. 14, 2007, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. In order to meet the demand for such natural resources, numerous companies invest significant amounts of time and money in searching for and extracting oil, natural gas, and other subterranean resources from the earth. Particularly, once a desired resource is discovered below the surface of the earth, drilling and production systems are employed to access and extract the resource. These systems can be located onshore or offshore depending on the location of a desired resource. Further, such systems generally include a wellhead assembly that is used to extract the resource. These wellhead assemblies include a wide variety of components and/or conduits, such as various control lines, casings, valves, and the like, that are conducive to drilling and/or extraction operations. In drilling and extraction operations, in addition to wellheads, various components and tools are employed to provide for drilling, completion, and the production of mineral resources. For instance, during drilling and extraction operations seals and valves are often employed to regulate pressures and/or fluid flow.

A wellhead system may include a various support structures, such as a casing spool or bowl or a tubing head or bowl, configured to secure and support tubing and casing suspended in the well bore. Additionally, a wellhead system may include pressure control and regulation devices, such as a "Christmas tree" or a blowout preventer (BOP). The blowout preventer can be used a primary or back-up pressure regulation device, and often prevents high-pressure release of oil, gas or other fluids in the well in the case of an overpressure condition. During the course of drilling or operating the well, it may be desirable to switch between different sizes of blowout preventers or pressure regulation devices. In such instances, the well is generally plugged or sealed in some manner so that oil, gas, or other fluids are contained within the well when the system's pressure regulation device is disengaged.

Typically, a plug may be used in the casing spool or bowl (or in the tubing spool or bowl) to plug the well, or a back-pressure valve may be used to relieve any pressure building up in the well. The plug may be installed before removal of a pressure regulation device, and then retrieved once another pressure regulation device is in place, using a retrieval tool, for example. In such instances, installation or removal of the plug may result in accidental release of pressure from the well, causing the plug to eject from the casing spool or bowl and exit the wellhead, for example. An accidental release may damage the plug or the wellhead, and may also result in the unintentional release of oil, gas, or other fluids in the well. Another challenge may include an attempt to equalize the pressure across the plug to prevent such a blowout or ejection of the plug. However, it may be difficult to accomplish such an equalization, and any unequal pressure may still allow the plug to potentially eject from the wellhead. Additionally, some wells may not be amendable to use of a back pressure valve, such as those using an annular blowout preventer. As a result, use of a plug may be used to seal these wells despite the various challenges and drawbacks. Further, the use of devices or techniques to allow safe installation and/or removal of the plug may introduce increased complexity and cost, and result in multiple trips into the wellhead.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Certain exemplary embodiments of the present technique include a system and method that addresses one or more of the above-mentioned challenges of conventional plug installation and retrieval systems and methods. As explained in greater detail below, the disclosed embodiments include a safety device, such as a retaining sleeve, that can be installed into a mineral extraction system in a single trip as a part of another tool, such as a tubing spool. In certain embodiments, the sleeve may include an annular body having a tapered edge, a retaining groove, and a selected ratio of inside diameter to outside diameter to accommodate the plug used with the sleeve. In one embodiment, any accidental ejection or release of the plug results in a shoulder of the plug contacting the tapered edge of the sleeve, such that the plug cannot eject from the wellhead. Embodiments of the present invention may also include a tubing spool having a retention mechanism for embodiments of the retaining sleeve. In one embodiment, the sleeve may be coupled to the tubing spool and the entire tubing spool and sleeve assembly may then be coupled to the casing spool of the wellhead. Once the sleeve is in place, the plug may then be retrieved via a retrieval tool.

Figure 1:
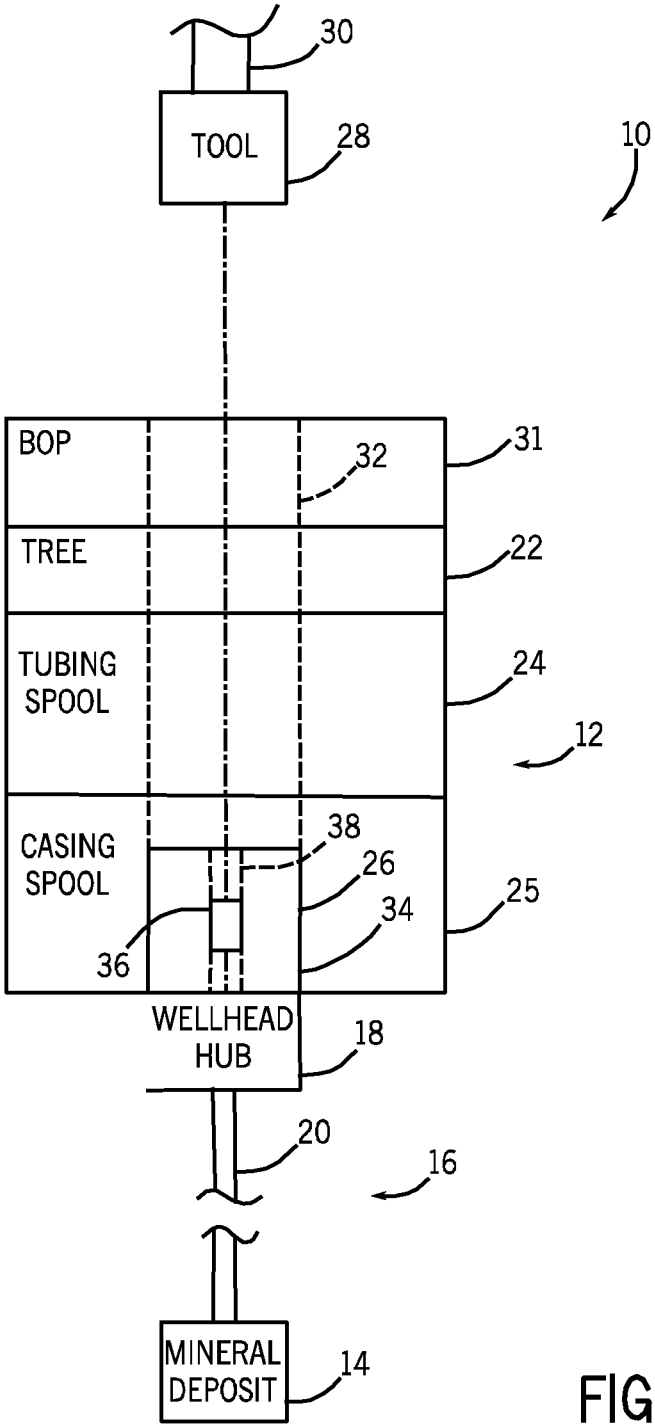
FIG. 1 is a block diagram that illustrates a mineral extraction system according to an embodiment of the present invention.

FIG. 1 is a block diagram that illustrates an embodiment of a mineral extraction system 10. The illustrated mineral extraction system 10 can be configured to extract various minerals and natural resources, including hydrocarbons (e.g., oil and/or natural gas), or configured to inject substances into the earth. In some embodiments, the mineral extraction system 10 is land-based (e.g., a surface system) or subsea (e.g., a subsea system). As illustrated, the system 10 includes a wellhead 12 coupled to a mineral deposit 14 via a well 16, wherein the well 16 includes a wellhead hub 18 and a well-bore 20.

The wellhead hub 18 generally includes a large diameter hub that is disposed at the termination of the well-bore 20. The wellhead hub 18 provides for the connection of the wellhead 12 to the well 16.

The wellhead 12 typically includes multiple components that control and regulate activities and conditions associated with the well 16. For example, the wellhead 12 generally includes bodies, valves and seals that route produced minerals from the mineral deposit 14, provide for regulating pressure in the well 16, and provide for the injection of chemicals into the well-bore 20 (down-hole). In the illustrated embodiment, the wellhead 12 includes what is colloquially referred to as a Christmas tree 22 (hereinafter, a tree), a tubing spool 24, a casing spool 25, and a hanger 26 (e.g., a tubing hanger or a casing hanger). The system 10 may include other devices that are coupled to the wellhead 12, and devices that are used to assemble and control various components of the wellhead 12. For example, in the illustrated embodiment, the system 10 includes a tool 28 suspended from a drill string 30. In certain embodiments, the tool 28 includes a running tool that is lowered (e.g., run) from an offshore vessel to the well 16 and/or the wellhead 12. In other embodiments, such as surface systems, the tool 28 may include a device suspended over and/or lowered into the wellhead 12 via a crane or other supporting device.

The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 32. The tree bore 32 provides for completion and workover procedures, such as the insertion of tools (e.g., the hanger 26) into the well 16, the injection of various chemicals into the well 16 (down-hole), and the like. Further, minerals extracted from the well 16 (e.g., oil and natural gas) may be regulated and routed via the tree 22. For instance, the tree 12 may be coupled to a jumper or a flowline that is tied back to other components, such as a manifold. Accordingly, produced minerals flow from the well 16 to the manifold via the wellhead 12 and/or the tree 22 before being routed to shipping or storage facilities. A blowout preventer (BOP) 31 may also be included, either as a part of the tree 22 or as a separate device. The BOP may consist of a variety of valves, fittings and controls to prevent oil, gas, or other fluid from exiting the well in the event of an unintentional release of pressure or an overpressure condition.

The tubing spool 24 provides a base for the tree 22. Typically, the tubing spool 24 is one of many components in a modular subsea or surface mineral extraction system 10 that is run from an offshore vessel or surface system. The tubing spool 24 includes a tubing spool bore 34. The tubing spool bore 34 connects (e.g., enables fluid communication between) the tree bore 32 and the well 16. Thus, the tubing spool bore 34 may provide access to the well bore 20 for various completion and worker procedures. For example, components can be run down to the wellhead 12 and disposed in the tubing spool bore 34 to seal-off the well bore 20, to inject chemicals down-hole, to suspend tools down-hole, to retrieve tools down-hole, and the like.

As will be appreciated, the well bore 20 may contain elevated pressures. For example, the well bore 20 may include pressures that exceed 10,000 pounds per square inch (PSI), that exceed 15,000 PSI, and/or that even exceed 20,000 PSI. Accordingly, mineral extraction systems 10 employ various mechanisms, such as seals, plugs and valves, to control and regulate the well 16. For example, plugs and valves are employed to regulate the flow and pressures of fluids in various bores and channels throughout the mineral extraction system 10. For instance, the illustrated hanger 26 (e.g., tubing hanger or casing hanger) is typically disposed within the wellhead 12 to secure tubing and casing suspended in the well bore 20, and to provide a path for hydraulic control fluid, chemical injections, and the like. The hanger 26 includes a hanger bore 38 that extends through the center of the hanger 26, and that is in fluid communication with the tubing spool bore 34 and the well bore 20. Unfortunately, pressures in the bores 20 and 34 may manifest through the wellhead 12 if not regulated. A back pressure valve, plug, or other sealing device 36 is often seated and locked in the hanger bore 38 to regulate the pressure. Similar sealing devices may be used throughout mineral extraction systems 10 to regulate fluid pressures and flows.

During operation of the well, the blowout preventer 31 may be removed and replaced by another blowout preventer. For example, during initial drilling and/or operation of the well 16, a larger blowout preventer may be used to accommodate larger casing strings and tools. For easier operation and use of the well, and easier installation and retrieval of equipment, a smaller blowout preventer may be used after some period of operation of the well 16. Thus, while removing the larger blowout preventer and installing a smaller blowout preventer, the well 16 may be sealed by the sealing device 36, such as a backpressure valve, a plug, or other sealing device. In some instances, the well 16, wellhead 12, blowout preventer 31, or other equipment may only be amenable to use of a plug to seal the well. Further, a backpressure valve may undesirably leak or lose pressure, affecting the performance of the seal of the well 16. When using a plug to seal the well 16, the methods used to install and/or remove the plug may allow a possibility of the plug being ejected from the well 16 if the pressure across the plug is not equalized, the plug is not vented, and/or an unexpected pressure levels are encountered. Thus, according to an embodiment of the invention, the mineral extraction system 10 may include a safety device, such as a sleeve, to prevent the plug from ejecting from the wellhead 12.

Figure 2:
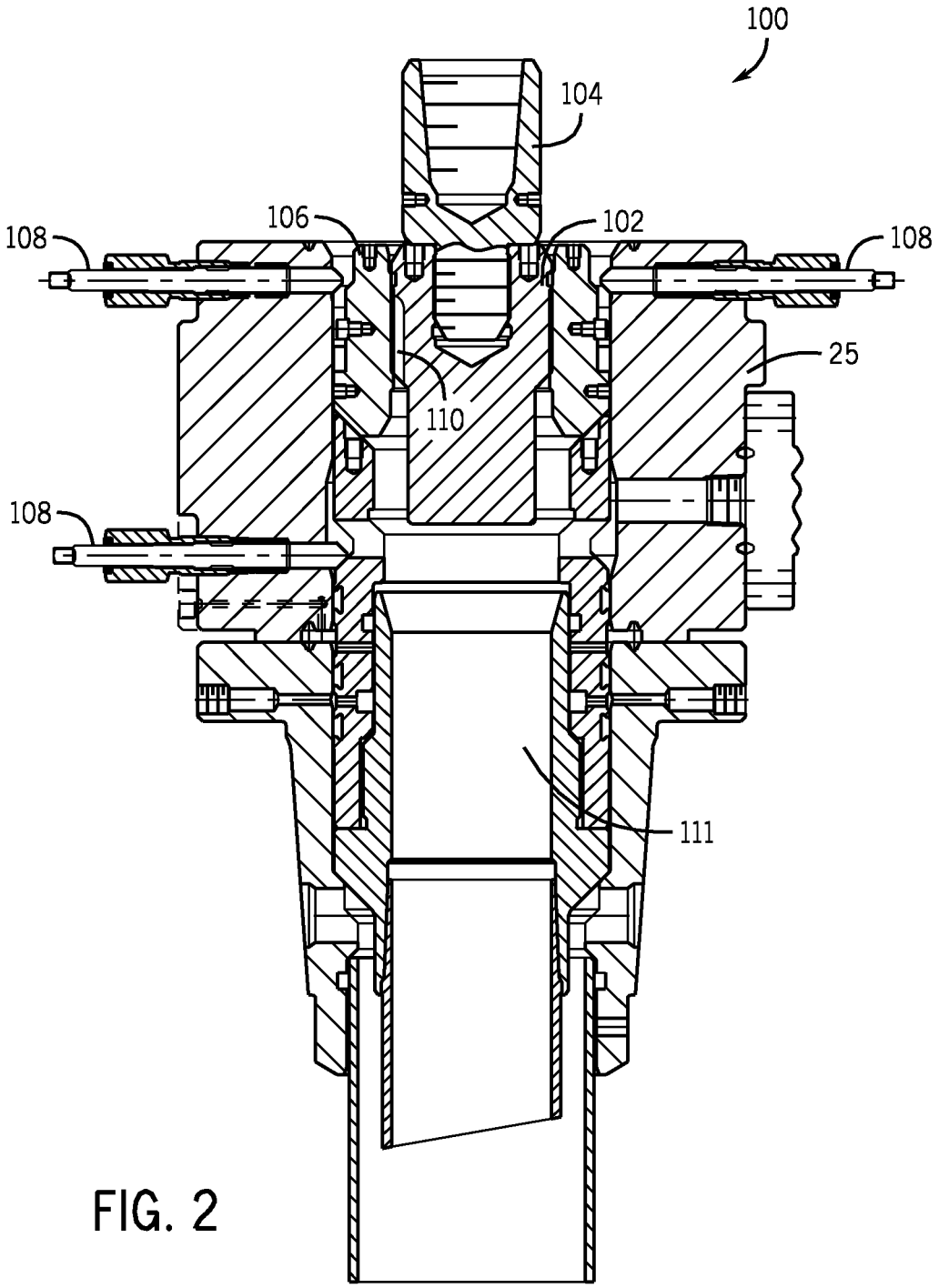
FIG. 2 is a partial cross-section of the mineral extraction system of FIG. 1 illustrating a plug in the mineral extraction system according to an embodiment of the present invention.

FIG. 2 depicts a cross section 100 of a plug 102 being inserted into the casing spool 25. As discussed above, the plug 102 may be inserted to plug the well during the removal of the blowout preventer 31. The plug 102 may be installed by an installation/retrieval tool 104 that may be coupled to the plug 102. The plug 102 may be retained in a casing hanger 106, and the casing hanger 106 may be retained in the casing spool 25 by tie down screws 108. As can be seen in FIG. 2, the plug 102 seals the bore of the wellhead 12 and prevents pressurized oil, gas or other fluids from releasing up the production tubing 111. The plug 102 may also include a relief groove 110 to relieve pressure in the wellhead. In some embodiments, the plug 102 may be primarily retained by threads on the body of the plug 102 or by lugs, screws, or other mechanical fasteners. In other embodiments, the plug may alternatively or additionally be sealed by an elastomer energized during installation of the plug. As discussed further below, a sleeve may retain the plug in the event the plug ejects up the wellhead if it accidentally unsecured or during removal of the plug.

Figure 3:
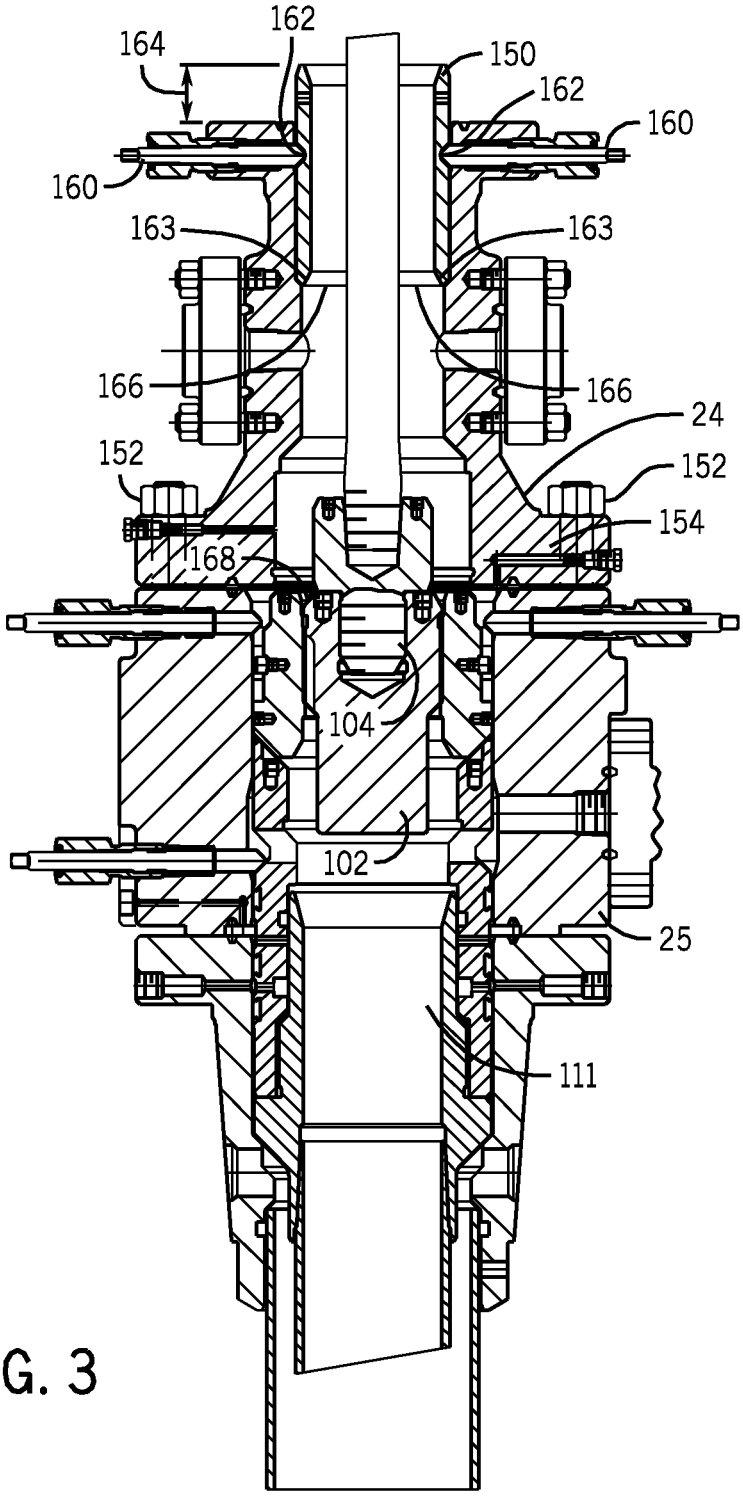
FIG. 3 is a partial cross-section of a sleeve and tubing spool coupled to the casing spool of FIG. 2 according to an embodiment of the present invention.

Turning now to FIG. 3, a cross-section of the tubing spool 24 having a safety device, e.g., a retaining sleeve 150, is shown coupled to the casing spool 25 of the wellhead 12. As discussed below the safety device, e.g., sleeve 150, may serve as a backup safety feature (or secondary retainer) to block the plug 102 after the primary retainer is released during removal of the plug 102. The tubing spool 24 may be coupled to the casing spool 25 by bolts 152 through a flange 154. In one embodiment, as described further below, the sleeve 150 may be first inserted into the tubing spool 24 before coupling to the casing spool 25.

In one embodiment, the sleeve 150 may be retained in the tubing spool 24 by tie down screws 160, which engage a retaining groove 162 in the sleeve 150. The sleeve 150 may be retained by any number of tie down screws, such as 2, 6, 8, 12, etc. In other embodiments, the sleeve 150 may be retained in the tubing spool 24 by hangers, snap rings, or any other suitable retention mechanism. Additionally, in some embodiments, the tubing spool 24 may include an annular recess 163 configured to solely or in combination with the above features retain the sleeve 150. In addition, to aid in installation and/or removal of the sleeve 150, the top portion 164 of the sleeve 150 may extend from the top of the tubing spool 24. During installation or removal of the sleeve 150, an operator or tool may grab or hold the sleeve 150 via the top portion 164. In other embodiments, the sleeve 150 may not include the top portion 164 extending above the tubing spool 24.

As discussed above, the retaining sleeve 150 is a safety device configured to block the plug 102 from releasing from the wellhead 12. This safety or backup retention feature of the sleeve 150 may also function to retain the sleeve 150 in the event that the primary retainer of the plug 102 fails. In either case, the sleeve 150 is configured to block axial movement of the plug 102 beyond some point in the wellhead 12. In the illustrated embodiment, the retaining sleeve 150 may be offset from the plug 102 by a distance, such that the retaining sleeve 150 does not function as a retainer until the plug 102 is released from its primary retainer and travels the distance up the wellhead.

In the illustrated embodiment, the bottom 166 of the sleeve 150 may engage the shoulder 168 of the plug if the plug 102 ejects to the top of the tubing spool 24. Otherwise, without such a safety member, e.g., sleeve 150, the plug 102 may be allowed to eject axially up through the tubing due to pressure differences in the system 10. In some embodiments, the bottom 166 of the sleeve 150 may be designed to optimally engage a shoulder 168 of the plug 102. For example, in the embodiment depicted in FIG. 3, the shoulder 168 portion of the plug 102 features a tapered or beveled edge; thus, the bottom 166 of the sleeve 150 may be tapered or beveled at an opposing angle so that the shoulder 168 of the plug 102 is flush against the bottom 166 of the sleeve 150 during engagement with the sleeve 150. Further, the sleeve 150 may also provide protection to the bore 34 of the wellhead 12 by covering the entire bore 34 in the area of the sleeve 150.

Figure 4:
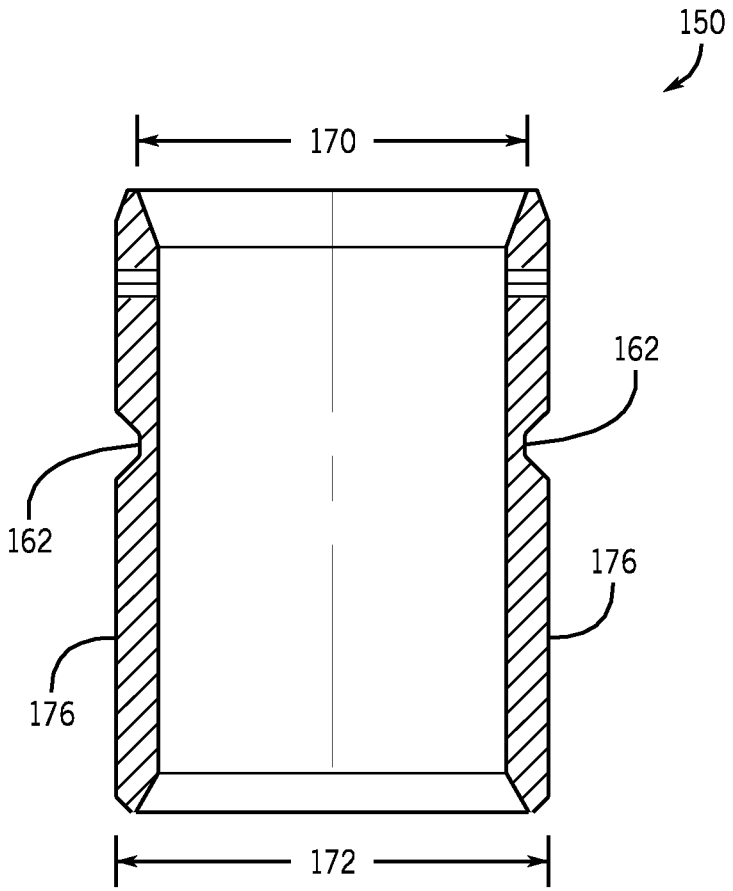
FIG. 4 is a cross-section of the sleeve of FIG. 3 according to an embodiment of the present invention.

FIG. 4 illustrates a cross-section of an embodiment of the retaining sleeve 150. As shown in FIG. 4, the retaining sleeve may be a generally annular shape having an inside diameter 170 and an outside diameter 172. The inside diameter 170 of the sleeve may be selected to allow tools, and any other equipment to pass through the sleeve when it is installed in the tubing spool 24. Additionally, the ratio of the inside diameter 170 to outside diameter 172 (or the thickness of the wall of the sleeve 150) may be selected to ensure optimal engagement with a plug or other tool intended to be retained by the sleeve 150. For example, the sleeve 150 should be thick enough to retain the plug 102 in the event of an accidental ejection of the plug 102 from the wellhead 12, but should also be thin enough to allow installation or removal of the tool 104 or other tools in the wellhead 12. Additionally, as mentioned above, the bottom of the sleeve 166 may be configured to engage the plug 102 and block the plug from ejecting.

As mentioned above, the sleeve 150 may also include the retaining groove 162 around the circumference of a section of an outer wall 176 of the sleeve 150. The retaining groove 162 may be deep enough to ensure retention of the sleeve 150 via one or more tie down screws, as illustrated above in FIG. 3. In some embodiments, the groove 162 may be formed around some or the entire circumference of the outer wall (e.g., annular groove). The sleeve 150 may be manufactured from steel, such as 4340 steel, 4140 steel, or may be formed from any other suitable material.

Figure 5:
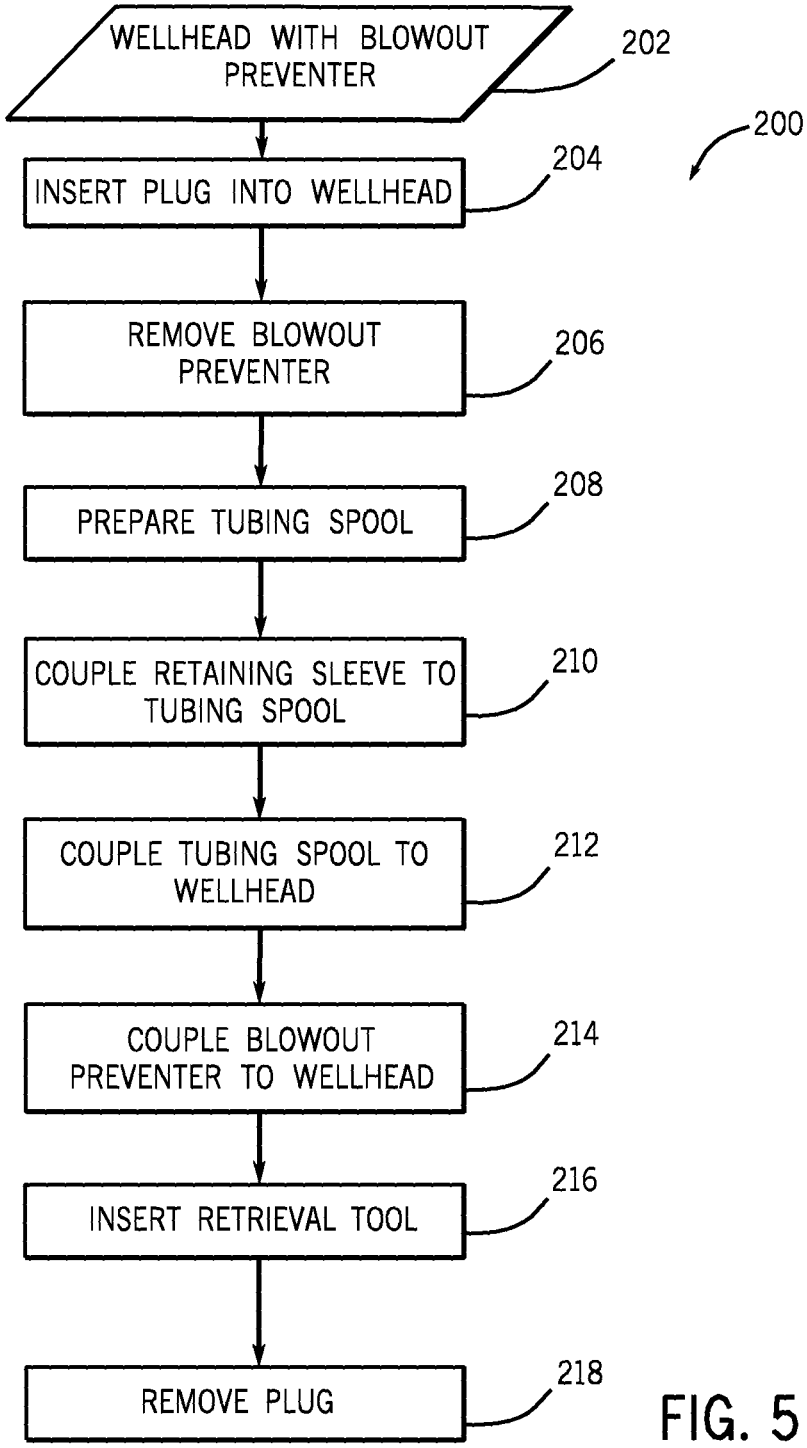
FIG. 5 is a flowchart illustrating a process for using the sleeve and tubing spool of FIGS. 2-4 according to an embodiment of the present invention.

Turning now to operation of the sleeve, FIG. 5 is a flowchart illustrating one embodiment of a process 200 for using the sleeve 150 with a mineral extraction system. Initially, a wellhead may already be in operation with a blowout preventer coupled to the "Christmas tree" or top of the wellhead (block 202). A plug may inserted into the wellhead (block 204), such as via a casing bowl or a plug insertion/retrieval tool, as discussed above. Once the well is plugged, the blowout preventer may be removed in preparation for replacement with a different size blowout preventer (block 206).

A separate tubing spool may be prepared for coupling to the wellhead (block 208). A retaining sleeve, such as illustrated in FIG. 4, may be coupled to the tubing spool via tie down screws or another suitable retention mechanism (block 210). After the sleeve is coupled to the tubing spool, the tubing spool may then be coupled to the casing spool of the wellhead (block 212). Once the tubing spool and sleeve are secured to the wellhead, the plug is ready for removal as the sleeve provides protection against accidental release of the plug during the removal process.

Another blowout preventer may be coupled to the Christmas tree and wellhead so that operation of the well may continue after the plug is removed (block 214). To remove the plug, a plug retrieval tool may be inserted into the tubing spool, through the bore of the sleeve, and into the plug (block 216), and the plug may be removed (block 218). In one embodiment, the retrieval tool may be reverse threaded and provide for unscrewing the plug after engagement. In other embodiments, depending on the primary retainer of the plug, other lugs, screws or fasteners may be removed to allow removal of the plug. When removing the plug, the retrieval tool, sleeve, and plug may all be removed at once, thus eliminating another insertion into the well to separately retrieve the sleeve. For example, during removal of the plug, the tie down screws or other mechanism retaining the sleeve may be removed so that when the plug contacts the sleeve, the sleeve may be pulled out with the plug. After the plug is removed, operation of the well may continue normally.

Although the embodiment described above illustrates an annular sleeve as a secondary retaining device for a wellhead plug, other shapes or designs may also be used. For example, in other embodiments the secondary retaining device may be tubular, cylindrical, rectangular, and may include various features, such as multiple retaining grooves, a plug receptacle, or a bottom portion of any shape such as flat, beveled, tapered, etc.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

an annular safety device configured to mount in a mineral extraction system with a plug, such that the annular safety device has a central axis parallel to the central axis of the plug and is disposable above the plug, wherein the annular safety device has a portion configured to block axial movement of a plug through the annular safety device in the mineral extraction system while the plug is removed from a retainer separate from the annular safety device along the central axis of the plug.

2. The system of claim 1, wherein the annular safety device is configured to catch the plug in the event of a pressure differential causing movement in the plug.

3. The system of claim 1, wherein the annular safety device is configured to supplement a plug removal tool while the annular safety device is still in place.

4. The system of claim 1, wherein an annular sleeve of the annular safety device comprises a groove around the circumference of an outer wall of the annular sleeve thereof.

5. The system of claim 4, wherein the groove is configured to engage a retention mechanism.

6. The system of claim 5, wherein the retention mechanism comprises one or more screws.

7. The system of claim 1, wherein an annular sleeve of the annular safety device comprises a tapered edge on an end portion thereof.

8. The system of claim 1, comprising a tubing spool having an annular sleeve of the annular safety device disposed therein, wherein a portion of the annular sleeve extends beyond a top surface of the tubing spool.

9. A system, comprising:

a tubular configured to receive an annular sleeve and couple to a mineral extraction system, wherein the tubular is configured to retain the annular sleeve, within an inner diameter of the tubular, as a safety device to block axial movement of a plug while the plug is released in the mineral extraction system.

10. The system of claim 9, wherein the tubular comprises a retention mechanism configured to retain the sleeve.

11. The system of claim 10, wherein the retention mechanism comprises an annular recess along an interior of the tubular.

12. The system of claim 10, wherein the retention mechanism comprises one or more screws.

13. The system of claim 9, wherein the tubular is coupled to a wellhead assembly, and the tubular comprises a tubing spool.

14. A system, comprising:

a plug configured to mount in a mineral extraction system; and an annular sleeve configured to mount in the mineral extraction system independent from the plug, wherein the annular sleeve is configured to block axial movement of the plug while the plug is axially moveable along a central axis of the plug within the mineral extraction system.

15. The system of claim 14, wherein the annular sleeve is not a primary retainer for the plug.

16. The system of claim 14, wherein the plug and the annular sleeve are axially offset and do not engage one another while the plug is retained within the mineral extraction system.

17. The system of claim 14, wherein the annular sleeve and the plug comprise tapered surfaces configured to engage one another to block axial movement of the plug.

18. The system of claim 14, comprising a tool configured to engage and retrieve the plug from the mineral extraction system.

19. The system of claim 14, wherein the mineral extraction system comprises a tubing spool, wherein the annular sleeve is mounted in the tubing spool.

20. A safety apparatus for a wellhead assembly with a plug, the apparatus comprising:

an annular member disposable in a wellhead assembly above the plug, wherein the internal diameter of the annular member is less than the external diameter of the plug, the annular member is configured to be disposed within an inner diameter of a tubular member of the wellhead assembly, and the annular member is configured to block axial movement of the plug within the inner diameter of the tubular member.

21. The annular member of claim 20, comprising a recessed portion disposed on the outer surface thereof.

22. The annular member of claim 21, wherein the recessed portion is a groove.

23. The annular member of claim 20, comprising a tapered edge on an end portion of the annular member.

24. A wellhead assembly comprising a plug insertable by a tool, comprising:

a tubular member;

the plug; and an annular member disposed above the plug;

wherein the annular member has an internal diameter less than the external diameter of the plug but greater than a diameter of the tool, and the annular member is configured to pass the tool through the internal diameter of the annular member.

25. The wellhead assembly of claim 24, wherein the annular member is not a primary retention mechanism for the plug.

26. The wellhead assembly of claim 24, wherein the plug and the annular member do not engage one another while the plug is retained in the wellhead assembly.

27. The wellhead assembly of claim 24, wherein the tubular member is a tubing spool.

28. A system, comprising:

an annular member configured for disposal in a wellhead assembly; and a plug configured for disposal in the same wellhead assembly below the annular member; wherein the annular member is configured to block axial movement of the plug, and the annular member is disposed within an internal diameter of a tubular member of the wellhead assembly.

29. The system of claim 28, wherein the annular member comprises a tapered support surface configured to be supported by a corresponding tapered support surface of the wellhead assembly.

30. The system of claim 28, wherein the plug comprises a receiving portion configured to receive an installation/removal tool.

31. The system of claim 28, comprising an installation/removal tool configured to couple to the receiving portion of the plug and to pass through the annular member.

* * * * *